US012209462B2

(12) United States Patent
Martin

(10) Patent No.: US 12,209,462 B2
(45) Date of Patent: Jan. 28, 2025

(54) DOWNHOLE TOOL FOR CONNECTING WITH A CONVEYANCE LINE

(71) Applicant: Impact Selector International, LLC, Heath, TX (US)

(72) Inventor: Brandon Martin, Forney, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/310,246

(22) Filed: May 1, 2023

(65) Prior Publication Data

US 2023/0349238 A1 Nov. 2, 2023

Related U.S. Application Data

(60) Provisional application No. 63/364,031, filed on May 2, 2022.

(51) Int. Cl.

| | |
|---|---|
| ***E21B 17/02*** | (2006.01) |
| ***E21B 17/042*** | (2006.01) |
| ***E21B 17/043*** | (2006.01) |
| ***E21B 17/046*** | (2006.01) |

(52) U.S. Cl.

CPC ..... *E21B 17/021* (2013.01); *E21B 17/028* (2013.01); *E21B 17/0426* (2013.01); *E21B 17/043* (2013.01); *E21B 17/046* (2013.01)

(58) Field of Classification Search

CPC ..... E21B 17/02; E21B 17/041; E21B 17/023; E21B 17/028; E21B 17/0426; E21B 17/043; E21B 17/046

See application file for complete search history.

(56) References Cited

U.S. PATENT DOCUMENTS

| | | | | |
|---|---|---|---|---|
| 4,697,641 | A * | 10/1987 | White | E21B 17/06 166/243 |
| 2016/0060967 | A1 | 3/2016 | Varkey et al. | |
| 2020/0217148 | A1* | 7/2020 | Massey | E21B 17/023 |
| 2022/0034169 | A1 | 2/2022 | Ariton | |

OTHER PUBLICATIONS

PCT/US2023/066443 International Search Report and Written Opinion of he International Searching Authority dated Sep. 25, 2023, 12 pages.

* cited by examiner

*Primary Examiner* — Nicole Coy
*Assistant Examiner* — Yanick A Akaragwe
(74) *Attorney, Agent, or Firm* — Boisbrun Hofman, PLLC

(57) ABSTRACT

A downhole tool for connecting with a conveyance line. The downhole tool may be or comprise a connector assembly operable to connect to the line. The connector assembly may include a first connector, a second connector, a latching member, and a rotatable member. The first connector and the second connector may be configured to accommodate the line therebetween. The latching member may be latched against the first connector. The rotatable member may be operatively connected with the latching member such that rotation of the rotatable member with respect to the latching member causes relative axial movement between the latching member and the rotatable member thereby forcing the first connector and the second connector toward each other to compress the line therebetween to therefore connect the connector assembly to the line.

15 Claims, 7 Drawing Sheets

DOWNHOLE TOOL FOR CONNECTING WITH A CONVEYANCE LINE

CROSS-REFERENCE TO RELATED APPLICATIONS

This application claims priority to and the benefit of U.S. Provisional Patent Application No. 63/364,031, entitled "DOWNHOLE TOOL FOR CONNECTING WITH A CONVEYANCE LINE," filed May 2, 2022, the entire disclosure of which is hereby incorporated herein by reference.

BACKGROUND OF THE DISCLOSURE

Wells are drilled into a land surface or ocean bed to recover natural deposits of oil, gas, and other natural resources that are trapped in geological formations in the Earth's crust. Testing and evaluation of completed and partially finished wells has become commonplace, such as to increase well production and return on investment. Downhole measurements of formation pressure and permeability, and recovery of formation fluid samples, may be useful for predicting economic value, production capacity, and production lifetime of geological formations. Furthermore, intervention operations in completed wells, such as installation, removal, and replacement of various production equipment, may also be performed as part of well repair or maintenance operations or permanent abandonment. A tool string comprising one or more downhole tools may be deployed within the wellbore to perform one or more of such downhole operations.

A tool string may be conveyed along a wellbore by applying controlled tension to the tool string from a wellsite surface via a conveyance line. An upper end of the tool string may comprise a cable head operable to mechanically and/or electrically connect the conveyance line to the tool string. A conveyance line, such as a greaseless cable, may include a smooth elastomeric sheath, which may reduce the amount of lubricant (e.g., grease) used during downhole conveyance and/or reduce the amount of friction formed against a sidewall of the wellbore during downhole conveyance. To connect the conveyance line with a cable head, the outer elastomeric sheath may be stripped from the end of the conveyance line to expose armor wires and electrical conductor(s). The armor wires may then be mechanically connected to the cable head and the electrical conductor(s) may be electrically connected with an electrical interface of the cable head to facilitate electrical connection with the rest of the tool string below the cable head.

A cable head may also facilitate separation of a conveyance line from a tool string. For example, when the tool string becomes stuck within a wellbore, tension may be applied to the conveyance line to break armor wires of the conveyance line at the cable head. The conveyance line may then be removed to the wellsite surface and fishing equipment may be conveyed downhole to couple with and retrieve the stuck tool string to a wellsite surface. However, actual strength of armor wires of a conveyance line is difficult to determine due to unknown level of metal fatigue underwent by the armor wires during past operations and unpredictable stress concentrations experienced by the armor wires when connected to the cable head. Thus, relying on rated or otherwise expected strength of individual armor wires to control tension at which the conveyance line separates (i.e., breaks) from the cable head can yield imprecise and/or inaccurate calculations that are much different from the actual tension that causes conveyance line separation during actual downhole operations.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
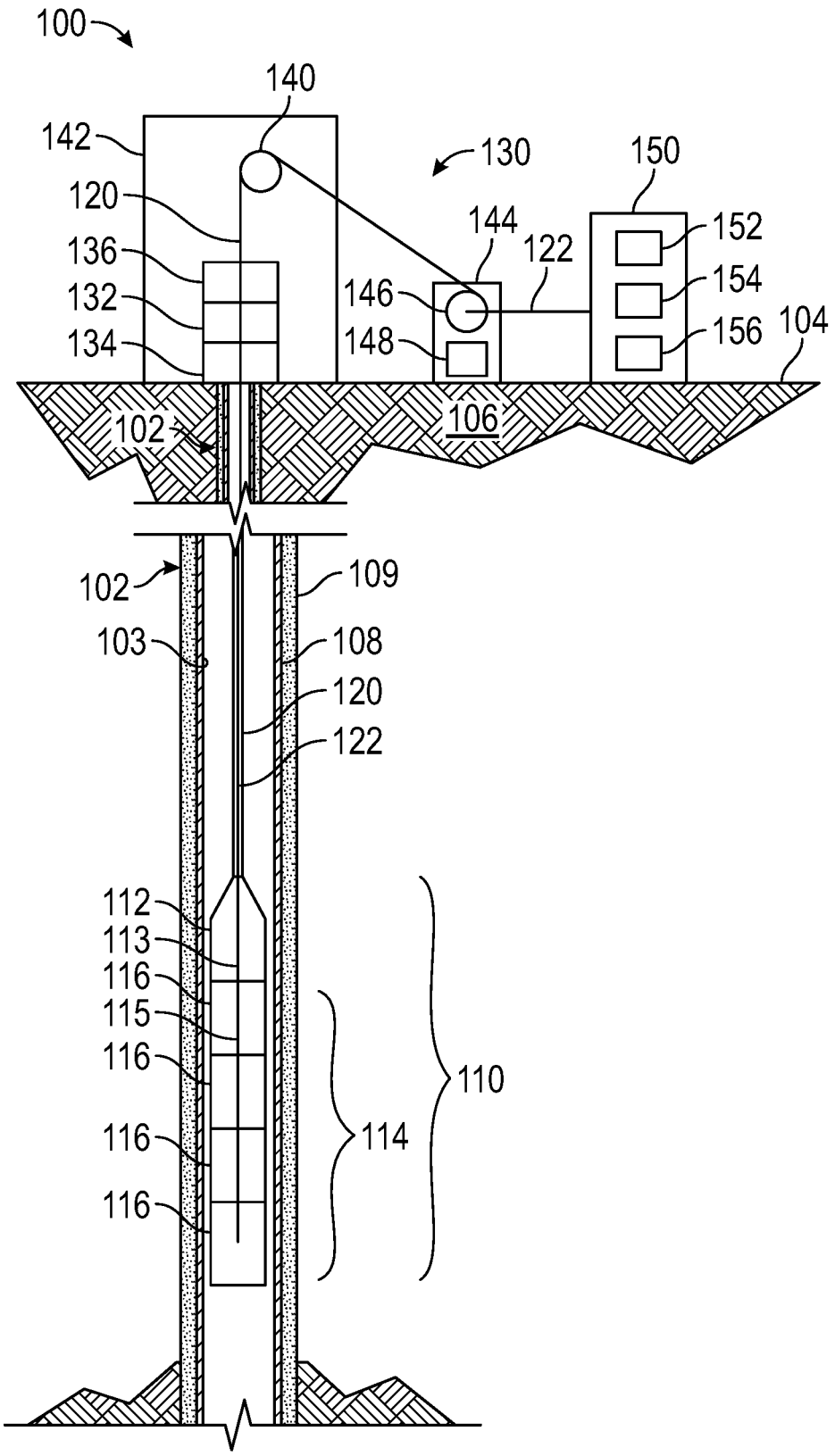
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Furthermore, terms, such as upper, upward, above, lower, downward, and/or below are utilized herein to indicate relative positions and/or directions between apparatuses, tools, components, parts, portions, members and/or other elements described herein, as shown in the corresponding figures. Such terms do not necessarily indicate relative positions and/or directions when actually implemented. Such terms, however, may indicate relative positions and/or directions with respect to a wellbore when an apparatus according to one or more aspects of the present disclosure is utilized or otherwise disposed within the wellbore. For example, the terms upper and upward may mean in the uphole direction or uphole from, and the terms lower and downward may mean in the downhole direction or downhole from.

FIG. 1 is a schematic view of at least a portion of an example implementation of a wellsite system 100 according to one or more aspects of the present disclosure, representing an example environment in which one or more aspects of the present disclosure may be implemented. The wellsite system 100 is depicted in relation to a wellbore 102 formed by rotary and/or directional drilling and extending from a wellsite surface 104 into a subterranean formation 106. The wellsite system 100 may be utilized to facilitate recovery of oil, gas, and/or other materials that are trapped in the subterranean formation 106 via the wellbore 102. A lower portion of the wellbore 102 is shown enlarged compared to an upper portion of the wellbore 102 adjacent the wellsite surface 104 to permit a larger and, thus, a more detailed depiction of various tools, tubulars, devices, and other objects disposed within the wellbore 102.

At least a portion of the wellbore 102 may be a cased-hole wellbore 102 comprising a casing 108 secured by cement 109, and/or a portion of the wellbore 102 may be an open-hole wellbore 102 lacking the casing 108 and cement 109. The wellbore 102 may also or instead contain a fluid conduit (e.g., a production tubing) (not shown) disposed within at least a portion of the casing 108 and/or an open-hole portion of the wellbore 102. Thus, one or more aspects of the present disclosure are applicable to and/or readily adaptable for utilizing in a cased-hole portion of the wellbore 102, an open-hole portion of the wellbore 102, and/or a fluid conduit disposed within a cased-hole and/or open-hole portion of the wellbore 102. It is also noted that although the wellsite system 100 is depicted as an onshore implementation, it is to be understood that the aspects described below are also generally applicable to offshore implementations.

The wellsite system 100 includes surface equipment 130 located at the wellsite surface 104. The wellsite system 100 also includes or is operable in conjunction with a downhole intervention tool and/or sensor assembly, referred to as a tool string 110, conveyed within the wellbore 102 along the subterranean formation 106 via a conveyance line 120 operably connected with one or more pieces of the surface equipment 130. The conveyance line 120 may be operably connected with a conveyance device 140 operable to apply an adjustable downward- and/or upward-directed force to the tool string 110 via the conveyance line 120 to convey the tool string 110 within the wellbore 102. The conveyance line 120 may be or comprise coiled tubing, a cable, a wireline, a slickline, a multiline, or an e-line, among other examples. The conveyance device 140 may be, comprise, or form at least a portion of a sheave or pulley, a winch, a draw-works, an injector head, and/or other device coupled to the tool string 110 via the conveyance line 120. The conveyance device 140 may be supported above the wellbore 102 via a mast, a derrick, a crane, and/or other support structure 142. The surface equipment 130 may further comprise a reel or drum 146 configured to store thereon a wound length of the conveyance line 120, which may be selectively wound and unwound by the conveyance device 140 to selectively convey the tool string 110 into, along, and out of the wellbore 102. Instead of or in addition to the conveyance device 140, the surface equipment 130 may comprise a winch conveyance device 144 comprising or operably connected with the drum 146. The drum 146 may be rotated by a rotary actuator 148 (e.g., an electric motor) to selectively unwind and wind the conveyance line 120 to apply an adjustable tensile force to the tool string 110 to selectively convey the tool string 110 into, along, and out of the wellbore 102.

The conveyance line 120 may comprise metal tubing, support wires (e.g., armor wires), and/or cables configured to support the weight of the downhole tool string 110. The conveyance line 120 may also comprise one or more insulated electrical and/or optical conductors 122 operable to transmit electrical energy (i.e., electrical power) and electrical and/or optical signals (e.g., sensor data, control data, etc.) between the tool string 110 and one or more components of the surface equipment 130, such as a power and control system 150. The conveyance line 120 may comprise and/or be operable in conjunction with a means for communication between the tool string 110, the conveyance device 140, the winch conveyance device 144, and/or one or more other portions of the surface equipment 130, including the power and control system 150. Such communication means may include surface and downhole communication (i.e., telemetry) devices operatively connected with the conveyance line 120.

A wellhead 134 may cap the upper (or surface) end of the wellbore 102. A plurality (e.g., a stack) of fluid control devices 132 may be mounted on top of the wellhead 134. The fluid control devices 132 may include fluid control valves, spools, and fittings individually and/or collectively operable to direct and control the flow of fluid out of the wellbore 102. The fluid control devices 132 may also or instead comprise a blowout preventer (BOP) stack operable to prevent the flow of fluid out of the wellbore 102. A sealing and alignment assembly 136 may be mounted on the fluid control devices 132. The sealing and alignment assembly 136 may be operable to seal the conveyance line 120 during deployment, conveyance, intervention, and other wellsite operations. The sealing and alignment assembly 136 may comprise a lock chamber (e.g., a lubricator, an airlock, a riser, etc.) and a stuffing box operable to seal around the conveyance line 120 at top of the lock chamber. The stuffing box may be operable to seal around an outer surface of the conveyance line 120, for example via annular packings applied around the surface of the conveyance line 120 and/or by injecting a fluid between the outer surfaces of the conveyance line 120 and an inner wall of the stuffing box. The tool string 110 may be deployed into or retrieved from the wellbore 102 via the conveyance device 140 and/or winch conveyance device 144 through the fluid control devices 132, the wellhead 134, and/or the sealing and alignment assembly 136.

The power and control system 150 (e.g., a control center) may be utilized to monitor and control various portions of the wellsite system 100. The power and control system 150 may be located at the wellsite surface 104 or on a structure located at the wellsite surface 104. However, the power and control system 150 may instead be located at a remote location from the wellsite surface 104. The power and control system 150 may include a source of electrical power 152, a control workstation 154 (i.e., a human machine interface (HMI)), and a surface controller 156 (e.g., a processing device or computer). The surface controller 156 may be communicatively connected with various equipment of the wellsite system 100, such as may permit the surface controller 156 to monitor operations of one or more portions of the wellsite system 100 and/or to provide control of one or more portions of the wellsite system 100, including the tool string 110, the conveyance device 140, and/or the winch conveyance device 144. The control workstation 154 may be communicatively connected with the surface controller 156 and may include input devices for receiving the control data (e.g., control commands) from human wellsite personnel and output devices for displaying sensor data (e.g., sensor measurements) to the human wellsite personnel. The surface controller 156 may be operable to receive and process the sensor data from the tool string 110 and/or control data entered to the surface controller 156 by the human wellsite personnel via the control workstation 154. The surface controller 156 may store executable computer programs and/or instructions and may be operable to implement or otherwise cause one or more aspects of methods, processes, and operations described herein based on the executable computer programs, the received sensor data, and the received control data.

The tool string 110 may comprise a cable head 112 operable to connect with the conveyance line 120. The cable head 112 may be or comprise a logging head, a line end termination head or sub, a line end connection head or sub, or other downhole tool operable to connect with the conveyance line 120 and a lower portion 114 of the tool string 110. The cable head 112 may physically and/or electrically connect the conveyance line 120 with or to the tool string 110, such as may permit the tool string 110 to be suspended and conveyed within the wellbore 102 via the conveyance line 120.

The cable head 112 may be selectively operable to release or otherwise disconnect from the conveyance line 120 to disconnect the tool string 110 from the conveyance line 120 while the tool string 110 is conveyed within the wellbore 102. Upon the cable head 112 releasing or disconnecting from the conveyance line 120, the conveyance line 120 can be retrieved to the wellsite surface 104 while the cable head 112 and the lower portion 114 of the tool string 110 are left in the wellbore 102. Accordingly, if a portion of the tool string 110 is stuck within the wellbore 102 and cannot be freed, the cable head 112 may be operated to release or otherwise disconnect from the conveyance line 120 such that the conveyance line 120 can be retrieved to the wellsite surface 104 and fishing equipment can be conveyed within the wellbore 102 to couple with and retrieve the stuck tool string 110 to the wellsite surface 104.

The cable head 112 may accommodate a portion of the conductor 122 and/or comprise an electrical conductor 113 electrically connected with the conductor 122. The lower portion 114 of the tool string 110 may comprise at least one electrical conductor 115 electrically connected with the conductor 122 or the conductor 113. Thus, the cable head 112 and the lower portion 114 of the tool string 110 may be electrically connected with one or more components of the surface equipment 130, such as the power and control system 150, via the electrical conductors 113, 115, 122. For example, the electrical conductors 113, 115, 122 may transmit and/or receive electrical power, data, and/or control signals between the power and control system 150 and one or more of the cable head 112 and the lower portion 114 of the tool string 110. The electrical conductor 115 may further facilitate electrical communication between two or more portions of the lower portion 114. Each of the cable head 112, the lower portion 114, and/or portions thereof may comprise one or more electrical conductors, connectors, and/or interfaces, such as may form and/or electrically connect the electrical conductors 113, 115.

The lower portion 114 of the tool string 110 may comprise at least a portion of one or more downhole tools 116 (e.g., tool string portions, modules, subs, devices, etc.) operable in wireline, completion, production, and/or other implementations. The tools 116 of the lower portion 114 may each be or comprise one or more of an acoustic tool, a cutting tool, a density tool, a depth correlation tool, a directional tool, an electrical power module, an electromagnetic (EM) tool, a fluid sampling tool, a formation testing tool, a formation logging tool, a gravity tool, a hydraulic power module, a magnetic resonance tool, a mechanical interface tool, a monitoring tool, a neutron tool, a nuclear tool, a photoelectric factor tool, a porosity tool, a power module, a ram, a release tool, a reservoir characterization tool, a resistivity tool, a seismic tool, a stroker tool, a surveying tool, and/or a telemetry tool, among other examples also within the scope of the present disclosure.

In an example implementation of the tool string 110, a tool 116 of the tool string 110 may be or comprise a telemetry/control tool, such as may facilitate communication between the tool string 110 and the surface equipment 130 and/or control of one or more portions of the tool string 110. The telemetry/control tool may comprise a telemetry tool and/or a downhole controller (not shown) communicatively connected with the power and control system 150 (including the surface controller 156) via the conductors 113, 115, 122 and with other portions of the tool string 110 via the conductors 113, 115. The downhole controller may be operable to receive, store, and/or process control data from the power and control system 150 for controlling one or more portions of the tool string 110. The downhole controller may be further operable to store and/or communicate to the power and control system 150 sensor data or other information generated by one or more sensors or instruments of the tool string 110.

A tool 116 of the tool string 110 may also or instead be or comprise an inclination sensor and/or other sensor, such an accelerometer, a magnetometer, a gyroscopic sensor (e.g., a micro-electro-mechanical system (MEMS) gyro), and/or other sensor for determining the orientation of the tool string 110 relative to the wellbore 102. A tool 116 of the tool string 110 may be or comprise a depth correlation tool, such as a casing collar locator (CCL) tool for detecting ends of casing collars by sensing a magnetic irregularity caused by the relatively high mass of an end of a collar of the casing 108. The depth correlation tool may also or instead be or comprise a gamma ray (GR) tool that may be utilized for depth correlation. The CCL tool and/or a GR tool may be utilized to determine the position of the tool string 110 or portions thereof, such as with respect to known casing collar numbers and/or positions within the wellbore 102. Therefore, the CCL tool and/or the GR tool may be utilized to detect and/or log the location of the tool string 110 within the wellbore 102, such as during conveyance within the wellbore 102 or other downhole operations.

A tool 116 of the tool string 110 may also or instead be or comprise a jarring (or impact) tool operable to impart an impact to a stuck portion of the tool string 110 to help free the stuck portion of the tool string 110. A tool 116 of the tool string 110 may also or instead be or comprise one or more perforating tools (or guns), such as may be operable to perforate or form holes though the casing 108, the cement 109, and a portion of the formation 106 surrounding the wellbore 102 to prepare the well for production. Each perforating tool may contain one or more shaped explosive charges operable to perforate the casing 108, the cement 109, and the formation 106 upon detonation. The tools 116 of the tool string 110 may also or instead be or comprise a plug and a plug setting tool for setting the plug at a predetermined position within the wellbore 102, such as to isolate or seal a downhole portion of the wellbore 102. The plug may be permanent or retrievable, facilitating the downhole portion of the wellbore 102 to be permanently or temporarily isolated or sealed, such as during well treatment (e.g., fracturing) operations.

Figure 2:
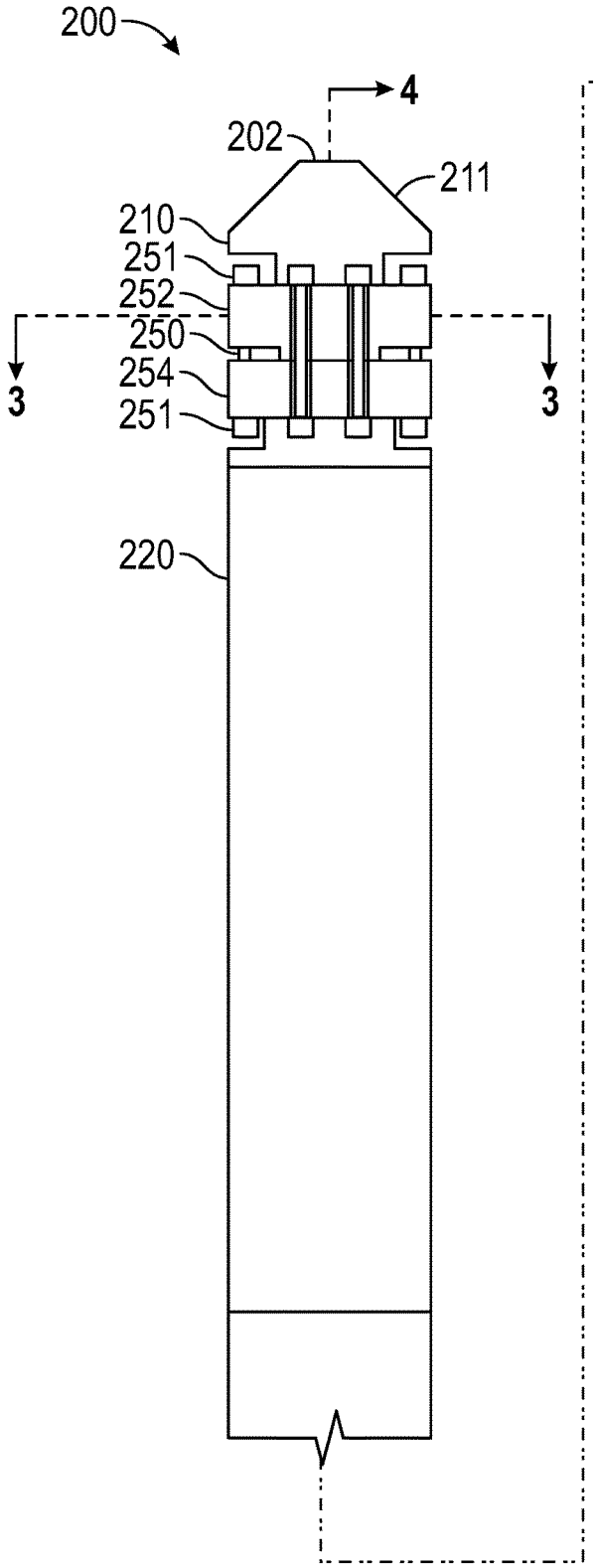
FIG. 2 is a side view of at least a portion of an example implementation of apparatus according to one or more aspects of the present disclosure.
Figure 2:
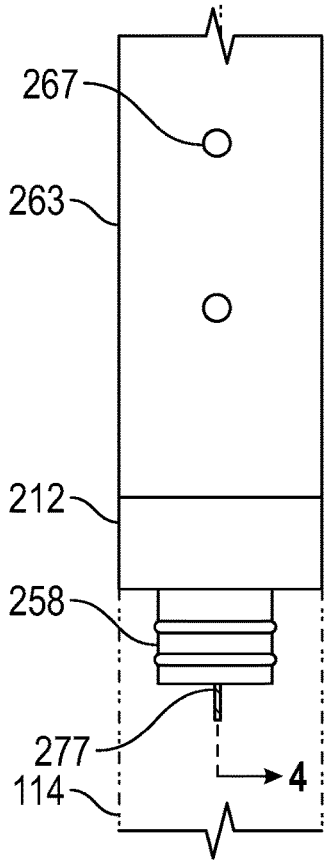
Figure 3:
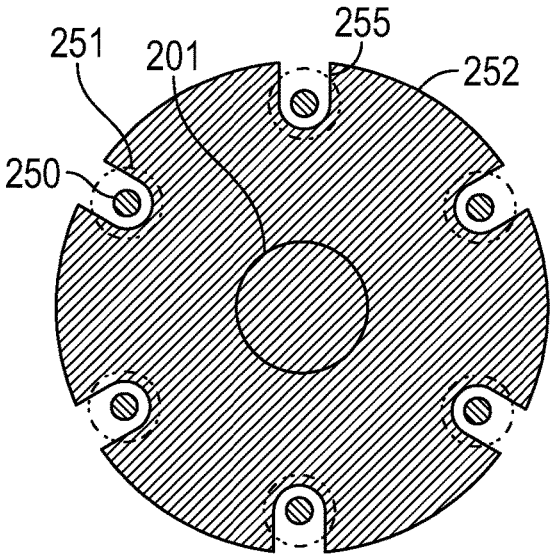
FIG. 3 is an axial sectional view of a portion of the apparatus shown in FIG. 2.
Figure 4:
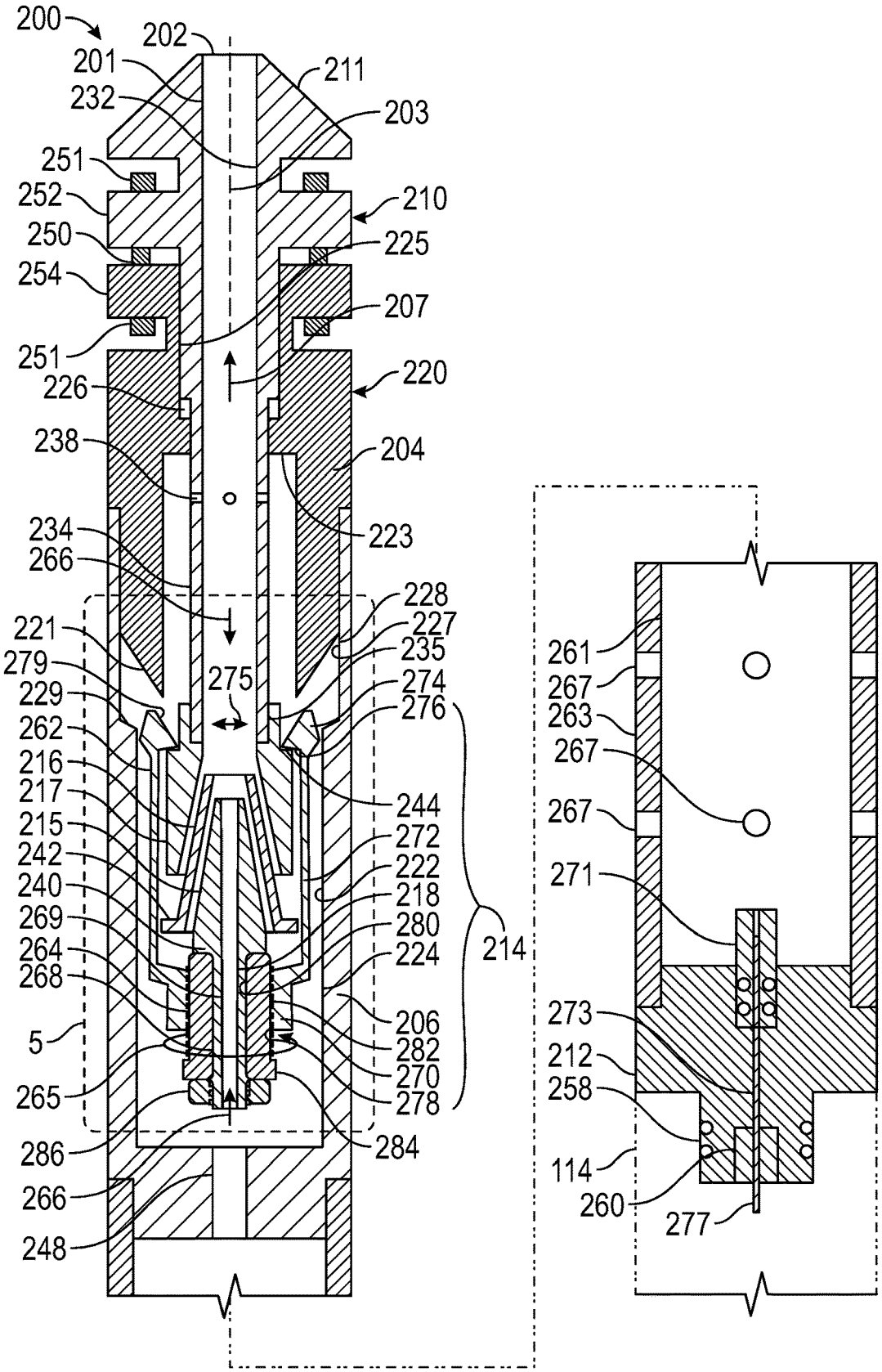
FIG. 4 is side sectional view of the apparatus shown in FIG. 2.
Figure 5:
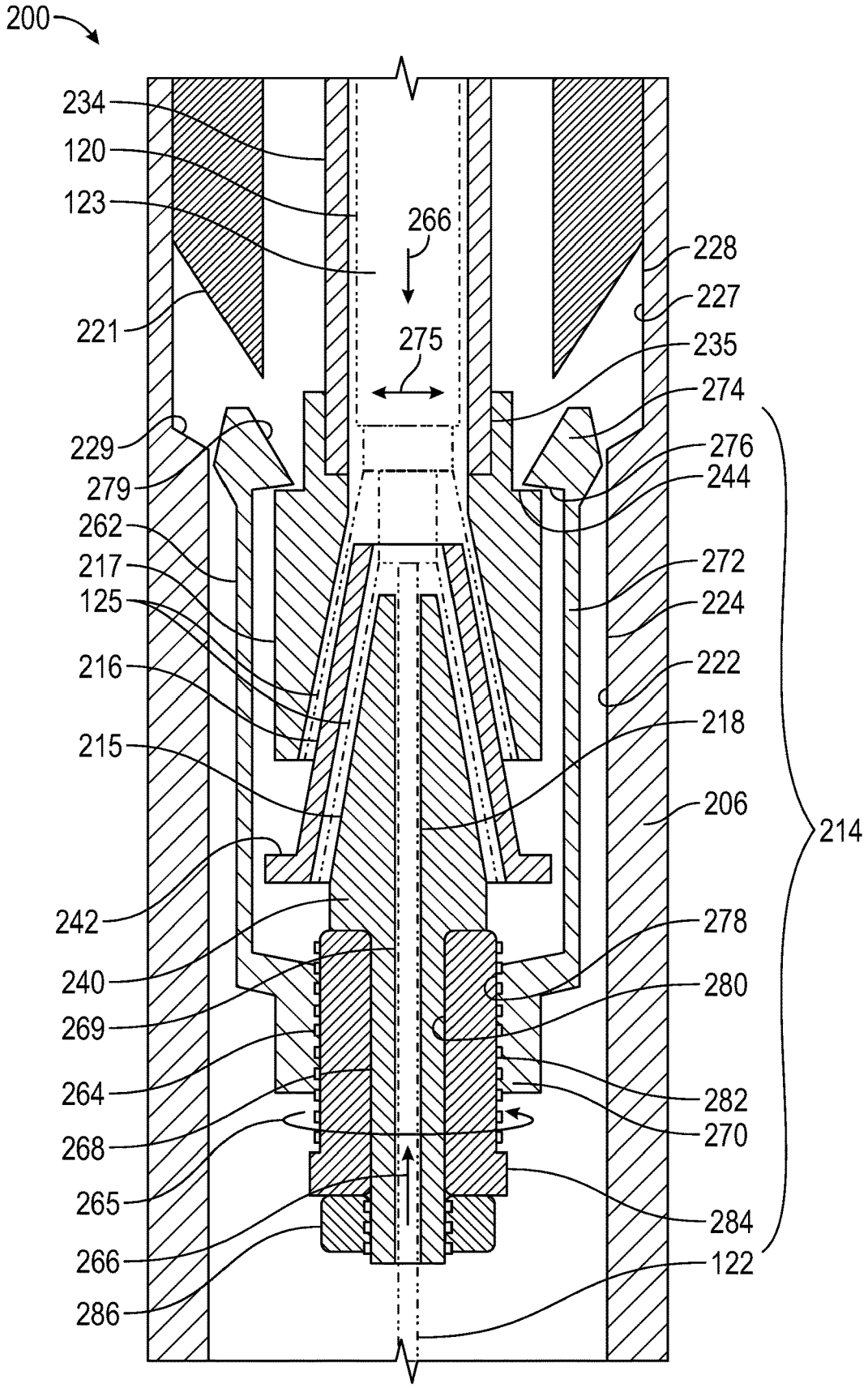
FIG. 5 is an enlarged view of a portion of the apparatus shown in FIG. 4.

FIG. 2 is a side view of at least a portion of an example implementation of a cable head 200 operable to connect to a conveyance line 120 according to one or more aspects of the present disclosure. FIG. 3 is an axial sectional view of the cable head 200 shown in FIG. 2. FIG. 4 is a side sectional view of the cable head 200 shown in FIG. 2. FIG. 5 in an enlarged side sectional view of a portion of the cable head 200 shown in FIG. 4. The cable head 200 is an example implementation of the cable head 112 shown in FIG. 1 and may comprise one or more features and/or modes of operation of the cable head 112. Accordingly, the following description refers to FIGS. 1-5, collectively.

The cable head 200 may comprise a plurality of interconnected bodies, housings, tubulars, sleeves, connectors, and other components collectively forming or otherwise defining a plurality of internal bores, spaces, and/or chambers for accommodating or otherwise containing various components of the cable head 200 mechanically and/or electrically connected to the conveyance line 120. For clarity and ease of understanding, the conveyance line 120 is shown in FIG. 5 using phantom lines. The conveyance line 120 may be or comprise a wire rope, a cable, a wireline, a multiline, an e-line, a braided line, a slickline, and/or other flexible line configured to convey a tool string 110 within a wellbore 102. The conveyance line 120 may comprise an outer cover (or sheath) 123 covering armor wires 125 of the conveyance line 120. However, the conveyance line 120 may be implemented without the outer cover 123 such that the armor wires 125 are exposed. The conveyance line 120 may comprise one or more electrical conductors, such as an electrical conductor 122, covered by the armor wires 125. However, the conveyance line 120 may be implemented with the armor wires 125, but without the electrical conductor 122. At a wellsite surface 104, the conveyance line 120 may be mechanically connected with a conveyance device 140 and/or a winch conveyance device 144 and the electrical conductor 122 may be communicatively connected with a power and control system 150.

The cable head 200 may comprise an axial bore (or chamber) 201 extending axially at least partially through the cable head 200. The bore 201 may be configured to receive or otherwise accommodate therein the conveyance line 120 when the cable head 200 is connected with the conveyance line 120. The cable head 200 and the bore 201 may have a longitudinal (e.g., central) axis 203. The cable head 200 may comprise an upper (or uphole) end 211 comprising an opening 202 of the bore 201. The upper end 211 may comprise a conical (or tapered) outer surface that extends diagonally along a radially inward and upward direction. The cable head 200 may further comprise a lower (or downhole) end comprising a lower connector 212 (e.g., a crossover) operable to mechanically and/or electrically connect the cable head 200 with a lower portion 114 of the tool string 110. The cable head 200 may thus facilitate conveyance of the tool string 110 within the wellbore 102. The cable head 200 may also facilitate electrical communication between the tool string 110 and the power and control system 150.

The cable head 200 may further comprise a body assembly comprising a lower body 220 (e.g., a lower housing, a lower sub, etc.) and an upper body 210 (e.g., an upper housing, an upper sub, etc.) telescopically, slidably, and/or otherwise movably connected with the lower body 220. The upper and lower bodies 210, 220 may each have a generally tubular geometry. The upper body 210 may be telescopically or otherwise slidably disposed at least partially within the lower body 220. The upper body 210 may be operable to connect with the conveyance line 120 and the lower body 220 may be operable to connect with the lower portion 114 of the tool string 110. The upper body 210 may be operable to move with respect to the lower body 220 when a predetermined tension is applied to the conveyance line 120 from the wellsite surface 104 by the conveyance device 140 and/or winch conveyance device 144 to cause the cable head 200 to progress though line release operations to release the conveyance line 120.

The lower body 220 may comprise a plurality of bodies, housings, and/or sleeves fixedly connected together and configured to move as single unit. For example, the lower body 220 may comprise a first lower body portion 204 and a second lower body portion 206 fixedly (e.g., threadedly) connected together and configured to move as single unit and not to move with respect to each other. The first lower body portion 204 may be partially disposed within the second lower body portion 206. The lower body portions 204, 206 may be fixedly connected via corresponding threads of the lower body portions 204, 206.

The upper body 210 may define the upper end 211 of the cable head 200 and may comprise an inner surface 232 defining the bore 201 configured to receive the conveyance line 120. The lower body 220 may comprise an inner surface defining a bore (or chamber) extending axially through the lower body 220. The bore of the lower body 220 may be configured to accommodate at least a portion of the upper body 210 and a line end connector assembly 214 (e.g., a line end termination device, a rope socket assembly, wedge and socket assembly, etc.) operable to connect with (e.g., compress) the armor wires 125 of the conveyance line 120 to mechanically connect the connector assembly 214 and, thus, the cable head 200, with the conveyance line 120. The inner surface of the lower body 220 may comprise different inner surface portions located at different axial positions along the lower body 220, each inner surface portion defining a different bore portion of the bore extending through the lower body 220. For example, the inner surface of the lower body 220 may comprise a first (or upper) inner surface portion 225 defining a first (or upper) bore portion 226, a second (or a lower) inner surface portion 222 defining a second (or a lower) bore portion 224, and a third (or an intermediate) inner surface portion 227 defining a third (or an intermediate) bore portion 228. An inner diameter of the bore portion 228 may be larger than an inner diameter of the bore portion 224. The inner diameter of the bore portion 224 may be larger than an inner diameter of the bore portion 226.

The first bore portion 226 may accommodate at least a portion of the upper body 210 and the second and third bore portions 224, 228 may accommodate the connector assembly 214. The upper body 210 may comprise a lower portion 234 (e.g., a tubular member) telescopically or otherwise slidably disposed within and extending through the bore portion 226 of the lower body 220. The lower portion 234 of the upper body 210 may slidably engage the inner surface 225 of the lower body 220. The lower portion 234 may also extend into the bore portions 224, 228.

The lower body 220 may further comprise a plurality of radial shoulders along the inner surface of the lower body 220 at different axial locations along the lower body 220. For example, the lower body 220 may comprise a circumferential shoulder 223, a circumferential shoulder 221 located below the shoulder 223, and a circumferential shoulder 229 located below the shoulder 221. The shoulder 223 may face downward and extend in a radially outward direction from the inner surface portion 225, the shoulder 221 may face downward and extend in a radially outward direction from the inner surface portion 227, and the shoulder 229 may face upward and extend (or transition) between the inner surface portion 222 and the inner surface portion 227. The shoulder 221 may be, comprise, or be defined by a conical (or tapered) outer surface that extends diagonally in the radially outward and upward direction.

The lower portion 234 of the upper body 210 may comprise a plurality of radial bores 238 (e.g., fluid ports) extending radially therethrough between the inner surface 232 (or the bore 201) and an outer surface of the lower portion 234. The bores 238 may fluidly connect the bore 201 of the upper body 210 and the bore (i.e., the bore portions 224, 226, 228) of the lower body 220 such that when the cable head 200 is disposed within the wellbore 102 during downhole operations, wellbore fluid located within the bore 201 between the inner surface 232 and the conveyance line 120 can flood or otherwise flow into the bore (i.e., the bore portions 224, 226, 228) of the lower body 220 to equalize pressure within the cable head 200 with wellbore pressure external to the cable head 200.

The upper body 210 may be fixedly connected with the lower body 220 via a plurality of breakable members 250 (e.g., pins, studs, etc.). For example, the breakable members 250 may fixedly connect (e.g., extend axially through or between) an upper flange 252 of the upper body 210 and a lower flange 254 of the lower body 220. The breakable members 250 may be distributed circumferentially along (or around) the upper and lower flanges 252, 254 and extend through or between the upper and lower flanges 252, 254. The breakable members 250 may be disposed within corresponding radial channels 255 extending axially along and/or radially into both the upper and lower flanges 252, 254, such that each opposing head 251 of a breakable member 250 contacts (e.g., abuts, latches against) an opposing upper and lower surface (e.g., shoulder, edge, etc.) of a corresponding upper and lower flange 252, 254. The breakable members 250 may be or comprise tension pins. The breakable members 250 may be selected from a plurality of different breakable members, each having a different tension strength (e.g., yield strength, breaking strength, etc.), thereby permitting predetermination (i.e., selection, setting, etc.) of axial force and, thus, line tension at which the breakable members 250 will break. After the breakable members 250 are broken, the line tension applied from the wellsite surface 104 can move the upper body 210 axially (along the axis 203) upward with respect to the lower body 220, as indicated by arrow 207, to cause the cable head 200 to progress through the line release operations to release the conveyance line 120.

The lower connector 212 may be mechanically connected with the lower body 220 via an intermediate housing 263 (e.g., a transition or connection hub). For example, the intermediate housing 263 may comprise opposing internal threads, each configured to engage corresponding external threads of the lower body 220 and of the lower connector 212 to fixedly connect the lower connector 212 with the lower body 220. The intermediate housing 263 may comprise or define an internal chamber (or space) 261, which may be open to the space external to the cable head 200 via a plurality of bores 267 (e.g., openings, ports, etc.) extending radially through the intermediate housing 263. The chamber 261 may thus be open to the wellbore fluid within the external space when the tool string 110 is disposed within the wellbore 102. A bore 248 may extend through the lower body 220 between the bore portion 224 and the chamber 261. The bore 248 may accommodate the electrical conductor 122 of the conveyance line 120 extending through the cable head 200. The bore 248 may also fluidly connect the chamber 261 and the internal bore (e.g., the bore portions 224, 224) of the lower body 220 such that when the cable head 200 is disposed within the wellbore 102 during downhole operations, wellbore fluid located within the chamber 261 can flood or otherwise flow into the internal bore of the lower body 220 to equalize pressure within the cable head 200 with wellbore pressure external to the cable head 200.

The lower connector 212 may be or comprise a coupler, an interface, and/or other means for mechanically and electrically coupling the cable head 200 with corresponding mechanical and electrical interfaces (not shown) of the lower portion 114 of the tool string 110. The lower connector 212 may include a mechanical interface, a sub, and/or other interface means 258 for mechanically coupling the cable head 200 with a corresponding mechanical interface of a downhole tool 116 of the lower portion 114 of the tool string 110. Although the interface means 258 is shown comprising a pin coupling, the interface means 258 may be or comprise a box coupling, other threaded connector, and/or other mechanical coupling means. The lower connector 212 may further comprise an electrical interface 260 for electrically connecting the cable head 200 and, thus, the conveyance line 120 with a corresponding electrical interface of the lower portion 114 of the tool string 110. The electrical interface of the lower portion 114 of the tool string 110 may be in electrical connection with the electrical conductor 115 of the lower portion 114. Although the electrical interface 260 is shown comprising a pin connector 277, the electrical interface 260 may comprise other electrical coupling means, including a receptacle, a plug, a terminal, a conduit box, and/or other electrical connector.

An electrical bulkhead connector 271 may be mechanically connected with the lower connector 212 and electrically connected with the electrical interface 260 via an electrical conductor 273 extending axially through the lower connector 212 between the electrical bulkhead connector 271 and electrical interface 260. The electrical interface 260 may be configured to electrically connect with a corresponding electrical connector of the lower portion 114 of the tool string 110 to electrically connect the electrical conductor 273 with the electrical conductor 115 of the lower portion 114. The bulkhead connector 271 may be fluidly sealed against the lower connector 212, such as to prevent or inhibit wellbore fluid within the chamber 261 to contact the electrical conductor 273 and/or leak into the lower portion 114 of the tool string 110 when the tool string 110 is conveyed within the wellbore 102. The bulkhead connector 271 may be operable to receive or otherwise connect with the electrical conductor 122 of the conveyance line 120 extending through the cable head 200.

The connector assembly 214 may be or comprise a line end connection and disconnection device operable to connect to an end of the conveyance line 120 and connect the conveyance line 120 to the upper body 210. The connector assembly 214 may be further operable to release the conveyance line 120 and, thus, disconnect the conveyance line 120 from the upper body 210 when a predetermined tension is applied to the conveyance line 120. Such tension may be applied from the wellsite surface 104 by the conveyance device 140 and/or winch conveyance device 144 or by a downhole device located within the wellbore 102 above the cable head 200. The connector assembly 214 may comprise an upper connector 217 and a lower connector 215. The connector assembly 214 may be operable to receive and compress the conveyance line 120 between the upper connector 217 and the lower connector 215 to connect with the conveyance line 120. The upper connector 217 may be further operable to move with respect to the lower connector 215 to uncompress the conveyance line 120 thereby releasing the conveyance line 120 when the predetermined tension is applied to the conveyance line 120. When the predetermined tension is applied to the conveyance line 120, the tension may cause the upper body 210 to move upward with respect to the lower body 220, as indicated by the arrow 207, thereby causing the upper connector 217 to move upward with respect to the lower connector 215 to release the conveyance line 120.

Figure 8:
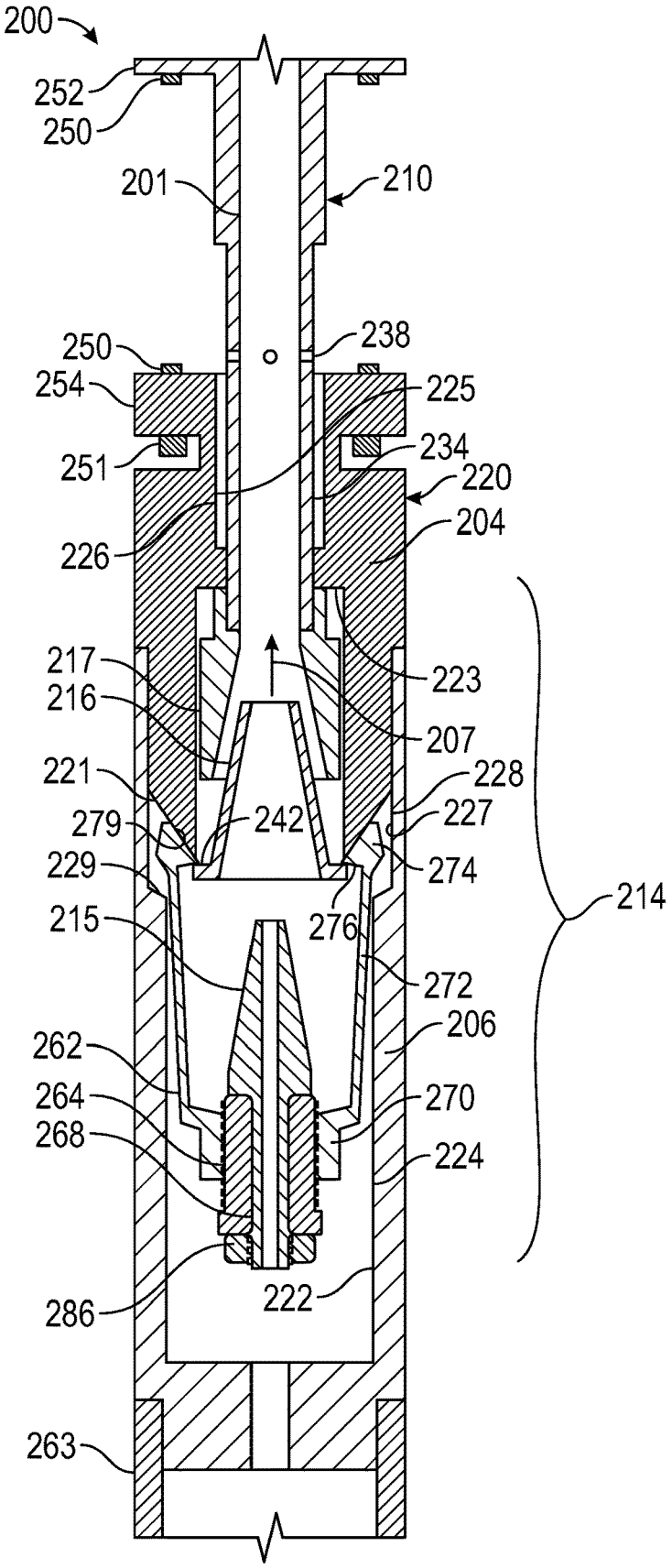

The connector assembly 214 may also comprise an intermediate connector 216 located between the upper connector 217 and the lower connector 215, such that the connector assembly 214 may be operable to receive and compress the conveyance line 120 between the connectors 217, 216, 215 to connect with the conveyance line 120. The upper and intermediate connectors 217, 216 may be operable to move with respect to the lower connector 215 and the upper connector 217 may be operable to move with respect to the intermediate and lower connectors 216, 215 to uncompress the conveyance line 120 thereby permitting the conveyance line 120 to be removed from between the connectors 217, 216, 215 to thereby disconnect from (or release) the conveyance line 120 when the predetermined tension is applied to the conveyance line 120. For example, when the predetermined tension is applied to the conveyance line 120, the tension may cause the upper body 210 to move upward with respect to the lower body 220 thereby causing the upper and intermediate connectors 217, 216 to move with respect to the lower connector 215 and the upper connector 217 to move with respect to the intermediate and lower connectors 216, 215 to release the conveyance line 120. Thus, the connectors 215, 216, 217 may be movable with respect to each other between a first position in which the connectors 215, 216, 217 are close together such that the connectors 215, 216, 217 compress the conveyance line 120 to thereby connect the connector assembly 214 with the conveyance line 120, and a second position in which the connectors 215, 216, 217 are separated from each other such that the connectors 215, 216, 217 do not compress the conveyance line 120 to thereby permit the conveyance line 120 to be removed from between the connectors 215, 216, 217 to thereby disconnect (or release) the connector assembly 214 from the conveyance line 120 when the predetermined tension is applied to the conveyance line 120. FIGS. 4 and 5 show the connectors 215, 216, 217 in their first position, and FIG. 8 shows the connectors 215, 216, 217 in their second position.

The connectors 215, 216, 217 may comprise one or more of an eye, an open socket, a closed socket, a thimble, a button, a wedge, a stud, a plug, a sleeve (e.g., a swaged sleeve), or other members operable to compress a conveyance line 120 to connect with the conveyance line 120. In an example implementation of the cable head 200, the connector assembly 214 may comprise a plurality of conical or otherwise mating or complementary members collectively operable to receive and compress the conveyance line 120 to mechanically connect the conveyance line 120 with the connector assembly 214. The connectors 215, 216, 217 may be concentrically (or axially) movable along the axis 203 and with respect to each other, and collectively operable to receive and compress armor wires 125 of the conveyance line 120 therebetween to mechanically connect the armor wires 125 with the connector assembly 214. For example, the upper connector 217 may be or comprise an outer conical member (e.g., a socket), the lower connector 215 may be or comprise an inner conical member (e.g., a wedge), and the intermediate connector 216 may be or comprise an intermediate member (e.g., an intermediate wedge and socket) comprising both a socket portion and a wedge portion.

The upper connector 217 may be configured to accommodate a portion of the intermediate connector 216, and the intermediate connector 216 may be configured to accommodate a portion of the lower connector 215. The upper connector 217 may comprise a conical (or tapered) inner surface that extends diagonally in a radially inward and upward direction. The upper connector 217 may further comprise an axial opening configured to accommodate the conductor 122 of the conveyance line 120. The intermediate connector 216 may comprise both conical inner and outer surfaces that extend diagonally in the radially inward and upward direction. The intermediate connector 216 may further comprise an axial opening configured to accommodate the conductor 122 of the conveyance line 120. The lower connector 215 may comprise a conical outer surface that extends diagonally in the radially inward and upward direction. The lower connector 215 may further comprise a bore 218 extending axially therethrough configured to accommodate the conductor 122 of the conveyance line 120. An outer layer of the armor wires 125 may be separated from the electrical conductor 122 of the conveyance line 120 and positioned (e.g., distributed) between the upper and intermediate connectors 217, 216, an inner layer of the armor wires 125 may be separated from the electrical conductor 122 and positioned between the lower and intermediate connectors 215, 216, and the conductor 122 may be passed through the openings of the upper and intermediate connectors 217, 216 and the bore 218. The connectors 215, 216, 217 may be brought together and compressed about the inner and outer layers of the armor wires 125 to connect the conveyance line 120 with the connector assembly 214. When the cable head 200 is intended to be connected with a conveyance line 120 comprising one layer of armor wires 125, the intermediate connector 216 may be omitted, and the armor wires 125 may be compressed between the lower and upper connectors 215, 217.

The lower connector 215 may be connected with or comprise a circumferential shoulder 240 (e.g., a flange, a rim, etc.) extending radially inward and facing downward from an outer surface of the lower connector 215. The intermediate connector 216 may be connected with or comprise a circumferential shoulder 242 (e.g., a flange, a rim, etc.) extending radially outward and facing upward from the base of the intermediate connector 216. The upper connector 217 may be connected with or comprise a circumferential shoulder 244 (e.g., a flange, a rim, etc.) extending radially outward and facing upward from an outer surface of the upper connector 217.

The connector assembly 214 may be movably (e.g., slidably) disposed within the bore portion 224. At least a portion of the connector assembly 214 may be connected to the upper body 210, such that upward movement of the upper body 210 with respect to the lower body 220, as indicated by the arrow 207, during the line release operations of the cable head 200 can cause movement of the connector assembly 214 (or at least a portion thereof) within the bore portion 224 and with respect to the lower body 220. The upper connector 217 may be fixedly connected with the lower portion 234 of the upper body 210, such as via a threaded connection 235.

The connector assembly 214 may further comprise a latching member 262 configured to latch against the upper connector 217 and a rotatable member 264 disposed (or latched) against (or in contact with) the lower connector 215. For example, the latching member 262 may be configured to latch against the shoulder 244 of the upper connector 217 and the rotatable member 264 may be disposed against the shoulder 240 of the lower connector 215. The latching member 262 and the rotatable member 264 may be operatively connected such that rotation of the rotatable member 264 with respect to the latching member 262, as indicated by arrow 265, causes relative axial movement (i.e., along the axis 203) between the latching member 262 and the rotatable member 264, as indicated by arrows 266, forcing the upper connector 217 and the lower connector 215 against each other to compress the armor wire therebetween to therefore connect the connector assembly 214 to the conveyance line 120. The latching member 262 and the rotatable member 264 may thus collectively be or form a latching mechanism 262, 264 operable to force the upper connector 217 and the lower connector 215 against each other to compress therebetween the armor wires 125 of the conveyance line 120 to therefore connect the connector assembly 214 to the conveyance line 120.

The latching member 262 may comprise a base 270 (e.g., a ring, a sleeve, etc.) and a plurality of heads 274 (e.g., latches, blocks, pins, dogs, etc.) connected to the base 270. The heads 274 may be connected to the base 270 via a plurality of flexible members 272 extending therebetween. The heads 274 and the base 270 may be on opposing sides of the flexible members 272. The flexible members 272 may be operable to flex (or bend) radially, thereby permitting the heads 274 to move radially with respect to the axis 203, as indicated by arrows 275. Each head 274 may comprise an inward-extending (or inward) shoulder (or latch) 276 configured to latch against the outward-extending (or outward) shoulder 244 of the upper connector 217. Each head 274 may be disposed against or otherwise in contact with the inner surface of the lower body 220, such as the inner surface portion 222 and the inner surface portion 227. Each head 274 may further comprise a diagonal (or tapered) inner surface 279 that extends diagonally in a radially outward and upward direction. Each diagonal inner surface 279 may be configured to engage (or contact) the outer surface of the shoulder 221 of the lower body 220 when the connector assembly 214 is moved axially upward with respect to the lower body 220 through the bore of the lower body 220, as indicated by the arrow 207, during the line release operations. The base 270 may comprise an inner surface 278 defining a bore extending axially therethrough and configured to accommodate the rotatable member 264. The latching member 262 may be or comprise a collet and the flexible members 272 may be or comprise flexible fingers of the collet. The inner surface 278 of the latching member 262 may also comprise an inner profile (e.g., splines, threads, teeth, pins, channels, etc.) configured to operatively engage the rotatable member 264. Thus, the rotatable member 264 may extend through the axial bore of the latching member 262 such that the rotatable member 264 and the latching member 262 operatively engage and, thus, operatively connect.

Although the latching member 262 is shown implemented as a collet, comprising a plurality of flexible members 272 connecting the heads 274 to the base 270, it is to be understood that the heads 274 may be connected to the base 270 by a sleeve extending therebetween. Such sleeve may be fixedly connected to the base 270 and comprise a plurality of radial openings configured to accommodate the heads 274. In such implementation, the heads 274 may be or comprise separate and discrete members (e.g., pins, dogs, etc.), each configured to extend through the radial openings of the sleeve and to move radially within such openings, as indicated by the arrows 275. Each such head 274 may comprise a corresponding shoulder 276 configured to latch against the shoulder 244 of the upper connector 217.

The connector assembly 214 may further comprise a mandrel 268 about which the rotatable member 264 rotates. The mandrel 268 may be integral to or a part of the lower connector 215, or otherwise connected to the lower connector 215. The mandrel 268 may comprise a bore 269 extending axially therethrough and configured to accommodate the electrical conductor 122 of the conveyance line 120 extending through the cable head 200. The mandrel 268 may be axially aligned with the lower connector 215 such that the bore 269 is axially aligned and connected with the bore 218 of the lower connector 215.

The rotatable member 264 may be or comprise a generally cylindrical member (e.g., a sleeve, a tube, etc.) comprising an outer surface 282 and an inner surface 280. The inner surface 280 may define an axial bore configured to accommodate the mandrel 268, such that the rotatable member 264 can rotate about the mandrel 268. An upper surface (or end) of the rotatable member 264 may contact, abut, or otherwise be disposed against the shoulder 240 of the lower connector 215. A friction-reducing member (e.g., a bushing, a ball bearing, etc.) (not shown) may be disposed between the lower connector 215 and the rotatable member 264. A friction-reducing member (e.g., a sleeve, a roller bearing, etc.) (not shown) may be disposed between the mandrel 268 and the rotatable member 264. The outer surface 282 of the rotatable member 264 may comprise an outer profile (e.g., splines, threads, teeth, pins, channels, etc.) configured to operatively engage and, thus, operatively connect with the inner profile along the inner surface 278 of the latching member 262.

The profiles of the latching member 262 and the rotatable member 264 may be or comprise corresponding (or engaging) threads. For example, the inner profile of the latching member 262 may be or comprise inner threads and the outer profile of the rotatable member 264 may be or comprise outer threads. The internal threads of the latching member 262 and the external threads of the rotatable member 264 may engage such that rotation of the rotatable member 264 with respect to the mandrel 268, as indicated by arrow 265, causes relative axial movement along the axis 203 between the latching member 262 and the rotatable member 264, as indicated by the arrows 266, thereby forcing the upper connector 217 and the lower connector 215 to wedge against each other to compress (or clamp) the armor wire of the conveyance line 120 therebetween to therefore connect the connector assembly 214 to the conveyance line 120.

A portion of the outer surface of the rotatable member 264 may comprise an outer profile 284 configured to facilitate mechanical rotation of the rotatable member 264, such as via a wrench, or other manual or automated rotation tool (not shown). For example, the outer profile 284 may be or comprise a plurality of flat outer surfaces (e.g., wrench flats) configured to permit mechanical connection between the rotatable member 264 and the rotation tool. The connector assembly 214 may further comprise a locking member 286 configured to connect to the mandrel 268 and maintain the rotatable member 264 disposed about the mandrel 268. The locking member 286 may prevent or inhibit the rotatable member 264 from moving axially with respect to the mandrel 268 and the lower connector 215. The locking member 286 may be or comprise a nut comprising internal threads configured to engage corresponding external threads located along an outer surface of a distal portion of the mandrel 268.

Figure 6:
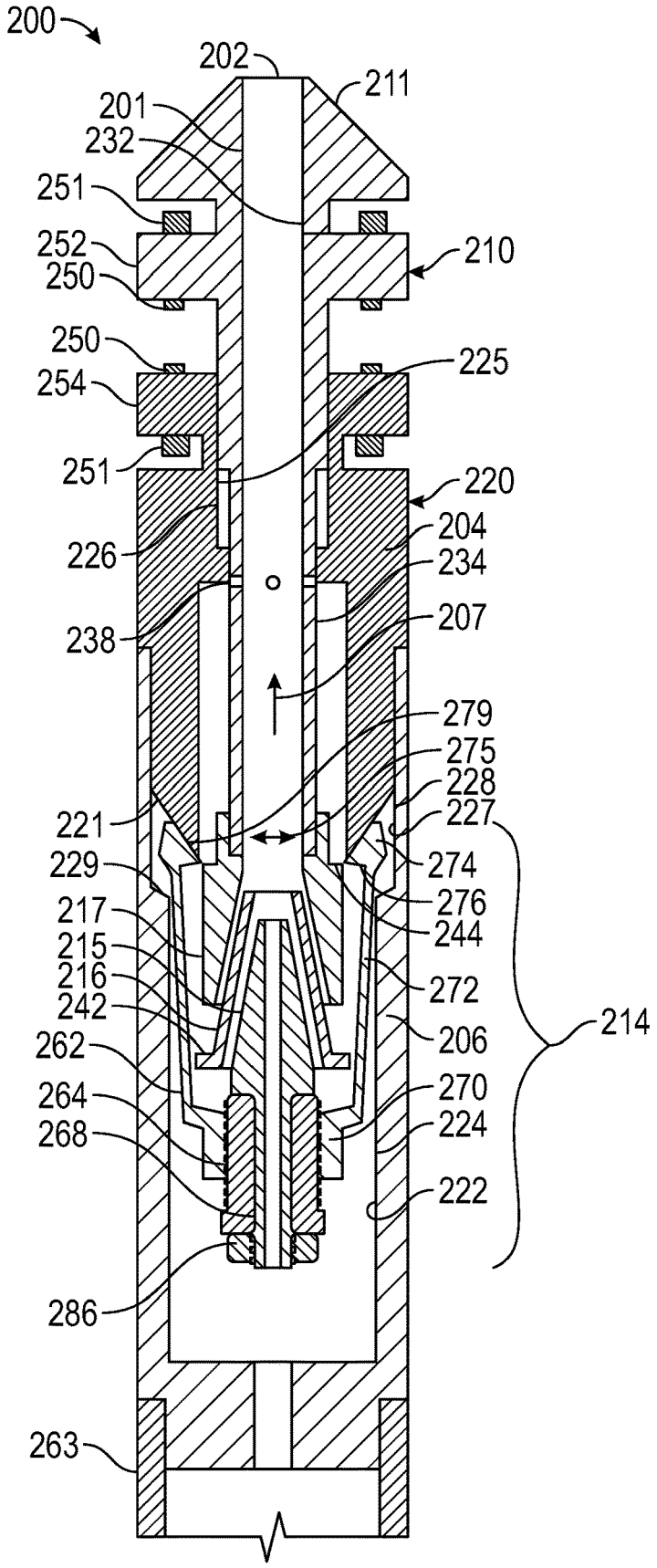
FIGS. 6-8 are side sectional views of the apparatus shown in FIG. 4 in different stages of release operations according to one or more aspects of the present disclosure.
Figure 7:
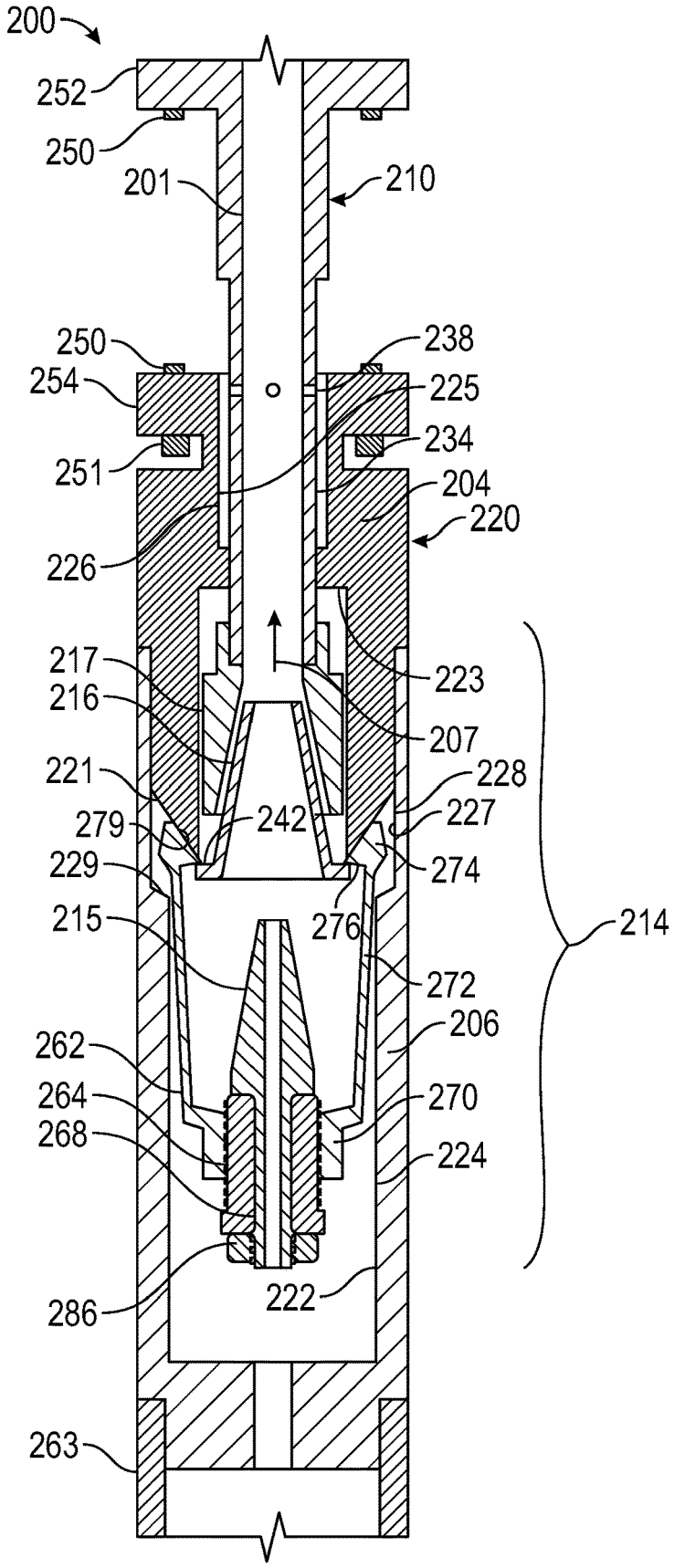

During the line release operations of the cable head 200, the connector assembly 214 may move upward within the bore of the lower body 220 with respect to the lower body 220, as indicated by the arrow 207. When the latching member 262 is fully within the bore portion 224 (as shown in FIGS. 4 and 5), the latching member 262 contacts the inner surface portion 222, which prevents the latching member 262 from moving in the radially outward direction, as indicated by the arrows 275, to maintain the latching member 262 latched against the upper connector 217. For example, when the heads 274 of the latching member 262 are fully within the bore portion 224, the heads 274 contact the inner surface portion 222, which prevents the heads 274 from moving in the radially outward direction to maintain the heads 274 latched against the upper connector 217. Thus, when the heads 274 (and the inward-extending shoulders 276) are disposed within the bore portion 224, the heads 274 may be disposed against or otherwise in contact with the inner surface portion 222 of the lower body 220 such that the inner surface portion 222 prevents the flexible members 272 and the heads 274 from moving in the radially outward direction to maintain the shoulders 276 of the latching member 262 latched against the shoulder 244 of the upper connector 217. However, when the latching member 262 is outside of the bore portion 224 (as shown in FIGS. 6-8), the latching member 262 may be free to move in the radially outward direction such that the latching member 262 is not latched against the upper connector 217. For example, when the heads 274 (and the inward-extending shoulders 276) are disposed outside of the bore portion 224, the heads 274 may not be disposed against or otherwise in contact with the inner surface portion 222 of the lower body 220 and, thus, be free to move in the radially outward direction such that the shoulders 276 of the latching member 262 are not latched against the shoulder 244 of the upper connector 217. Thus, when the heads 274 are disposed within the bore portion 228, the heads 274 may not contact the inner surface portion 227 and, thus, the inner surface portion 227 may not prevent the flexible members 272 and the heads 274 from moving in the radially outward direction thereby permitting the flexible members 272 and the heads 274 to move in the radially outward direction such that the inward-extending shoulders 276 of the latching member 262 are not latched against the outward-extending shoulder 244 of the upper connector 217.

The latching mechanism 262, 264 may thus be movable between a first position in which the latching mechanism 262, 264 latches together the connectors 215, 216, 217 to thereby maintain the connectors 215, 216, 217 in their first position, and a second position in which the latching mechanism 262, 264 does not latch together the connectors 215, 216, 217 to thereby permit the connectors 215, 216, 217 to move to their second position. FIGS. 4 and 5 show the latching mechanism 262, 264 in its first position, in which the latching mechanism 262, 264 maintains the connectors 215, 216, 217 in their first position. FIGS. 6-8 show the latching mechanism 262, 264 in its second position, in which the latching mechanism 262, 264 permits the connectors 215, 216, 217 to move to their second position.

The present disclosure is further directed to methods (e.g., operations, processes, etc.) of assembling and operating the cable head 200. Referring now to FIGS. 1-5, the cable head 200 may be assembled via a plurality of steps.

For example, the cable head 200 may be assembled by inserting the upper body 210 into the lower body 220. The breakable members 250 may then be selected based on the amount of tension that is intended to cause the conveyance line 120 to be released from the cable head 200. The selected breakable members 250 may then be inserted into the radial channels 255 to connect the flanges 252, 254 and, thereby, fixedly connect the upper and lower bodies 210, 220. The conveyance line 120 may then be passed through the bore 201 of the upper body 210. The sheath 123 at the end of the conveyance line 120 may be stripped, thereby exposing the armor wires 125.

The connector assembly 214 may then be connected to the conveyance line 120. For example, the outer layer of the armor wires 125 may be spread (or distributed) against an inner surface of the upper connector 217 and the inner layer of armor wires 125 and the conductor 122 may be passed through the intermediate connector 216. The inner layer of armor wires 125 may be spread (or distributed) against an inner surface of the intermediate connector 216 and the conductor 122 may be passed through the bore 218 of the lower connector 215 and the axial bore 269 of the mandrel 268. The lower connector 215 may then be forced (e.g., hammered) into the intermediate connector 216 thereby forcing the intermediate connector 216 into the upper connector 217 to compress the armor wires 125 between the connectors 215, 216, 217.

The assembly process may continue by disposing the latching member 262 about the connectors 215, 216, 217 such that the shoulders 276 of the latching member 262 are latched against the shoulder 244 of the upper connector 217, then inserting the rotatable member 264 about the mandrel 268 and into the bore of the latching member 262 such that the corresponding threads of the rotatable member 264 and the latching member 262 can engage. The assembly may continue by rotating the rotatable member 264, as indicated by the arrow 265, while the threads of the rotatable member 264 and the latching member 262 are engaged, causing relative axial movement between the latching member 262 and the rotatable member 262, as indicated by the arrows 266, until the rotatable member 264 extends through the opening of the latching member 262 and the rotatable member 264 is disposed against (or contacts) the lower connector 215. The second lower body portion 206 of the lower body 220 may then be disposed about the connector assembly 214 and connected to the first lower body portion 204 of the lower body 220 such that the connector assembly 214 is disposed within the bore portion 224 of the lower body 220. The upper connector 217 may then be connected to the lower portion 234 of the upper body 210 (e.g., via the threaded connection 235) to connect the connector assembly 214 to the upper body 210. The rotatable member 264 may then be rotated further (or tightened) to impart an axial clamping force to the upper connector 217 and the lower connector 215, as indicated by the arrows 266, thereby forcing the connectors 215, 216, 217 against each other to compress the armor wires 125 therebetween to therefore connect the connector assembly 214 to the conveyance line 120. The locking member 286 may then be connected to the mandrel 268.

However, a different order of assembly may be implemented to connect the connector assembly 214 to the upper body 210. For example, the assembly operations may include connecting the upper connector 217 to the lower portion 234 of the upper body 210, then distributing the armor wires 125 between the connectors 215, 216, 217 and passing the conductor 122 though the bores 218, 269 of the lower connector 215 and the mandrel 268 (as described above), then disposing the latching member 262 about the connectors 215, 216, 217 such that the shoulders 276 of the latching member 262 are latched against the shoulder 244 of the upper connector 217. The assembly operations may continue by inserting the rotatable member 264 about the mandrel 268 and into the bore of the latching member 262 such that the corresponding threads of the rotatable member 264 and the latching member 262 can engage, and then rotating the rotatable member 264 while the threads of the rotatable member 264 and the latching member 262 are engaged, thereby causing relative axial movement between the latching member 262 and the rotatable member 262 until the rotatable member 264 extends through the opening of the latching member 262 and the rotatable member 264 is disposed against (or contacts) the lower connector 215. The second lower body portion 206 of the lower body 220 may then be disposed about the connector assembly 214 and connected to the first lower body portion 204 of the lower body 220 such that the connector assembly 214 is disposed within the bore portion 224 of the lower body 220. The rotatable member 264 may be rotated further (or tightened) to impart the clamping axial force to the upper connector 217 and the lower connector 215, as indicated by the arrows 266, thereby forcing the connectors 215, 216, 217 against each other to compress the armor wires 125 therebetween to therefore connect the connector assembly 214 to the conveyance line 120. However, the second lower body portion 206 of the lower body 220 may be disposed about the connector assembly 214 and connected to the first lower body portion 204 of the lower body 220 such that the connector assembly 214 is disposed within the bore portion 224 of the lower body 220 after the rotatable member 264 is tightened to compress the armor wires 125 between the connectors 215, 216, 217. The locking member 286 may then be connected to the mandrel 268.

Thereafter, the conductor 122 may be electrically connected with the electrical bulkhead connector 271, the intermediate housing 263 may be connected with the lower body 220, and the lower connector 212 may be connected with the intermediate housing 263, thereby connecting the lower connector 212 with the lower body 220. The lower portion 114 of the tool string 110 may then be connected to the lower connector 212.

The present disclosure is further directed to methods (e.g., steps, operations, processes) of operating the cable head 200 shown in FIGS. 2-5. FIGS. 6-8 are sectional side views of the cable head 200 in various stages of line release operations according to one or more aspects of the present disclosure. Accordingly, the following description refers to FIGS. 1-8, collectively.

The cable head 200 shown in FIGS. 2-5 is in a connected or otherwise normal operational stage or position, in which the cable head 200 is connected to the conveyance line 120 and used to transmit tension generated by the conveyance device 140 and/or winch conveyance device 144 at the wellsite surface 104 to the tool string 110, such as during downhole measuring operations, downhole logging operations, downhole intervention operations, and/or other conveyance operations of the tool string 110. The assembled tool string 110 may be conveyed within the wellbore 102 and caused to perform intended operations via various downhole tools 116 forming the tool string 110. While the tool string 110 is conveyed downhole, wellbore fluid may flow into the internal space (i.e., the bore portions 224, 228) of the lower body 220 and the bore 201 via various fluid passages (i.e., the bores 267, 238, 248 and the chamber 261) to equalize pressure within the cable head 200 with wellbore pressure external to the cable head 200.

When it is intended to disconnect the conveyance line 120 from the tool string 110 to permit the conveyance line 120 to be retrieved to the wellsite surface 104, such as when the tool string 110 is stuck within the wellbore 102, the cable head 200 may be operated to release the conveyance line 120 from the cable head 200. The cable head 200 may progress though a sequence of stages (or positions) during the line release operations. To initiate the release of the conveyance line 120 from the cable head 200, the conveyance device 140 and/or winch conveyance device 144 at the wellsite surface 104 may be operated to impart a tension to the conveyance line 120 that exceeds the collective strength of the breakable members 250, thereby breaking the breakable members 250 and causing the conveyance line 120 to be released by the cable head 200. During the line release operations, the tension applied to the conveyance line 120 may be transferred to the connector assembly 214, thereby urging the connector assembly 214 to move in the upward direction, as indicated by the arrow 207. The connector assembly 214, in turn, may push the upper body 210 in the upward direction with respect to the lower body 220, thereby imparting tension to the breakable members 250.

As shown in FIG. 6, when sufficient tension is applied by the conveyance device 140 and/or winch conveyance device 144, the breakable members 250 break, permitting the connector assembly 214 and the upper body 210 to move upward with respect to the lower body 220, as indicated by the arrow 207. The upper body 210 may continue moving upward until the heads 274 are disposed within the bore portion 228 and the diagonal inner surfaces 279 of the latching member 262 engage the diagonal outer surface of the shoulder 221 of the lower body 220, causing the heads 274 (and the inward-extending shoulders 276) to move in the radially outward direction, as indicated by the arrows 275, such that the inward-extending shoulders 276 of the latching member 262 are not latched against the outward-extending shoulder 244 of the upper connector 217. The connector assembly 214 may continue to move upward with the upper body 210 until the heads 274 of the latching member 262 engage (or latch against) the shoulder 221 of the lower body 220, such that the latching member 262 cannot move further upward.

As shown in FIG. 7, the upper body 210, the upper connector 217, and the intermediate connector 216 may continue moving upward with respect the lower body 220 while the latching member 262 engages the shoulder 221 of the lower body 220, thereby preventing the lower connector 215 from moving upward. As the upper connector 217 and the intermediate connector 216 continue to move upward, the intermediate connector 216 separates from the lower connector 215 to uncompress the inner layer of the armor wires 125 disposed between the intermediate connector 216 and the lower connector 215. The upper body 210, the upper connector 217, and the intermediate connector 216 may continue moving upward, as indicated by the arrow 207, with respect the lower body 220 until the shoulder 242 of the intermediate connector 216 engages (or latches against) the shoulder 221 of the lower body 220 and/or the shoulders 276 of the latching member 262.

As shown in FIG. 8, the upper body 210 and the upper connector 217 may continue moving upward with respect the lower body 220 while the shoulder 242, which engages the shoulder 221 of the lower body 220 and/or the shoulders 276 of the latching member 262, prevents the intermediate connector 216 from moving upward, thereby separating the upper connector 217 from the intermediate connector 216 to uncompress the outer layer of the armor wires 125 disposed between the upper connector 217 and the intermediate connector 216. The upper body 210 and the upper connector 217 may continue to move upward, as indicated by the arrow 207, until the upper connector 217 contacts the shoulder 223 of the lower body 220, thereby preventing the upper body 210 from detaching from the lower body 220. With all of the armor wires 125 of the conveyance line 120 being uncompressed, the conveyance line 120 may be free to be moved upward (i.e., pulled out) along the bore 201 and out of the cable head 200, and retrieved to the wellsite surface 104.

Fishing equipment (not shown) may then be deployed downhole and coupled or otherwise engaged with the tool string 110 left in the wellbore 102. The fishing equipment may engage a neck, a profile, or an outer surface of the cable head 200 and/or other portion of the tool string 110. Thereafter, fishing operations to be employed to free the tool string 110.

In view of the entirety of the present disclosure, including the figures and the claims, a person having ordinary skill in the art will readily recognize that the present disclosure introduces an apparatus comprising a connector assembly operable to connect to a line, wherein the connector assembly comprises: (1) a first connector; (2) a second connector, wherein the first connector and the second connector are configured to accommodate the line therebetween; (3) a latching member latched against the first connector; and (4) a rotatable member operatively connected with the latching member such that rotation of the rotatable member with respect to the latching member causes relative axial movement between the latching member and the rotatable member thereby forcing the first connector and the second connector toward each other to compress the line therebetween to therefore connect the connector assembly to the line.

The first connector may comprise a socket and the second connector may comprise a wedge.

The first connector may comprise an outward shoulder extending in a radially outward direction, the latching member may comprise a plurality of inward shoulders each extending in a radially inward direction, and the inward shoulders may be latched against the outward shoulder.

The latching member may comprise a collet.

The latching member may comprise internal threads, the rotatable member may comprise external threads, and the internal threads and the external threads may engage such that rotation of the rotatable member with respect to the latching member causes relative axial movement between the latching member and the rotatable member thereby forcing the first connector and the second connector toward each other to compress the line therebetween to therefore connect the connector assembly to the line.

The latching member may comprise an inner surface defining an axial bore, the inner surface may comprise internal threads, the rotatable member may comprise external threads, the rotatable member may extend though the axial bore, and the internal threads and the external threads may engage such that rotation of the rotatable member with respect to the latching member causes relative axial movement between the latching member and the rotatable member thereby forcing the first connector and the second connector toward each other to compress the line therebetween to therefore connect the connector assembly to the line.

The rotatable member may be rotatably connected to the second connector.

The connector assembly may further comprise a mandrel connected to the second connector, and the rotatable member may be rotatably disposed about the mandrel.

The present disclosure also introduces an apparatus comprising a connector assembly operable to connect to a line that comprises wires, wherein the connector assembly comprises: (1) a first connector comprising a socket and an outward shoulder extending in a radially outward direction; (2) a second connector comprising a wedge, wherein the socket and the wedge are configured to accommodate the wires therebetween; (3) a latching member comprising: (a) a plurality of inward shoulders each extending in a radially inward direction, wherein the inward shoulders are configured to latch against the outward shoulder; and (b) internal threads; and (4) a rotatable member comprising external threads that engage the internal threads such that, when the wires are between the socket and the wedge and the inward shoulders are latched against the outward shoulder, rotation of the rotatable member with respect to the second connector causes relative axial movement between the latching member and the rotatable member thereby forcing the socket and the wedge toward each other to compress the wires therebetween to therefore connect the connector assembly to the line.

The latching member may comprise a collet.

The rotatable member may be rotatably connected to the second connector.

The connector assembly may further comprise a mandrel connected to the second connector, and the rotatable member may be rotatably disposed about the mandrel.

The present disclosure also introduces an apparatus comprising a downhole tool operable to connect with a line and be conveyed within a wellbore, wherein the downhole tool is operable to release the line when a predetermined tension is applied to the line, and wherein the downhole tool comprises a body assembly and a connector assembly disposed within the body assembly, wherein the connector assembly is operable to connect to the line, and wherein the connector assembly comprises: (1) a first connector comprising a socket and an outward shoulder extending in a radially outward direction; (2) a second connector comprising a wedge, wherein the socket and the wedge are configured to accommodate the line therebetween, and wherein the first connector and the second connector are movable with respect to each other between: (a) a first position in which the socket and the wedge are close together such that the socket and the wedge compress the line to thereby connect the connector assembly to the line; and (b) a second position in which the socket and the wedge are separated from each other such that the socket and the wedge do not compress the line thereby permitting the line to be removed from between the socket and the wedge to thereby disconnect the connector assembly from the line; and (3) a latching member comprising a plurality of inward shoulders each extending in a radially inward direction, wherein the latching member is movable between: (a) a first position in which the inward shoulders are latched against the outward shoulder thereby maintaining the first connector and the second connector in their first position; and (b) a second position in which the inward shoulders are not latched against the outward shoulder thereby permitting the first connector and the second connector to move to their second position.

The latching member may further comprise internal threads, the connector assembly may further comprise a rotatable member rotatably connected to the second connector, and the rotatable member may comprise external threads that engage the internal threads such that, when the latching member is in its first position, rotation of the rotatable member with respect to the second connector causes relative axial movement between the latching member and the rotatable member thereby forcing the socket and the wedge toward each other to compress the line and therefore connect the connector assembly to the line. The connector assembly may further comprise a mandrel connected to the second connector, and the rotatable member may be rotatably disposed about the mandrel.

The latching member may comprise a plurality of flexible members each connected with a corresponding one of the inward shoulders.

The body assembly may comprise an inner surface defining a bore, the connector assembly may be disposed within the bore, and the inner surface may comprise: a first inner surface portion defining a first bore portion having a first inner diameter; and a second inner surface portion defining a second bore portion having a second inner diameter. The first inner diameter may be smaller than the second inner diameter. When the inward shoulders are disposed within the first bore portion, the first inner surface may prevent the inward shoulders from moving in the radially outward direction to thereby maintain the latching member in its first position. When the inward shoulders are disposed within the second bore portion, the inward shoulders may be free to move in the radially outward direction to thereby permit the latching member to move to its second position.

The body assembly may comprise a first body and a second body, the first body and the second body may be fixedly connected to each other, and the connector assembly may be connected to the first body. When the downhole tool is conveyed within the wellbore and the predetermined tension is applied to the line, the first body may be operable to move with respect to the second body to cause the connector assembly to move with respect to the second body thereby permitting the latching member to move from its first position to its second position and thereby permitting the first connector and the second connector to move from their first position to their second position. A portion of the first body may be slidably disposed within the second body. The connector assembly may be disposed within the second body.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. An apparatus comprising:

a line end termination device operable to connect to an end of a line, wherein the line end termination device comprises:

a first compression member;

a second compression member, wherein the first compression member and the second compression member are configured to accommodate therebetween armor wires of the line;

a latching member comprising a shoulder extending in a radially inward direction, wherein the shoulder is configured to latch against the first compression member; and a rotatable member disposed against the second compression member, wherein the rotatable member and the latching member are operatively connected such that, when the armor wires are between the first compression member and the second compression member and the shoulder is latched against the first compression member, rotation of the rotatable member with respect to the latching member causes relative movement between the latching member and the rotatable member thereby forcing the first compression member and the second compression member toward each other to compress the armor wires therebetween to therefore connect the line end termination device to the end of the line.

2. The apparatus of claim 1 wherein the first compression member comprises a socket, and wherein the second compression member comprises a wedge.

3. The apparatus of claim 1 wherein the shoulder is an instance of a plurality of shoulders each extending in the radially inward direction, and wherein each of the shoulders is configured to latch against the first compression member.

4. The apparatus of claim 3 wherein:

the latching member further comprises a base and a plurality of fingers;

each of the fingers connects a corresponding instance of the shoulders to the base; and the rotatable member and the base are operatively connected.

5. The apparatus of claim 4 wherein:

the base comprises an inner surface defining an axial bore;

the inner surface comprises internal threads;

the rotatable member comprises an external surface comprising external threads; and the rotatable member extends though the axial bore such that the internal threads and the external threads engage to operatively connect the rotatable member and the base.

6. The apparatus of claim 1 wherein:

the latching member further comprises threads;

the rotatable member comprises threads; and the threads of the latching member and the threads of the rotatable member engage to operatively connect the rotatable member and the latching member.

7. The apparatus of claim 1 wherein the latching member comprises a collet.

8. The apparatus of claim 1 wherein the rotatable member is rotatably connected to the second compression member.

9. The apparatus of claim 1 wherein the line end termination device further comprises a mandrel connected to the second compression member, and wherein the rotatable member is disposed about the mandrel such that the rotatable member is rotatable about the mandrel.

10. The apparatus of claim 1 comprises a downhole tool operable to connect to the end of the line and be conveyed within a wellbore via the line, wherein the downhole tool comprises:

the line end termination device; and a body assembly comprising an inner chamber, wherein the line end termination device is disposed within the inner chamber.

11. An apparatus comprising:

a downhole tool operable to connect to an end of a line and be conveyed within a wellbore via the line, wherein the downhole tool comprises:

a body assembly comprising an inner chamber; and a line end termination device disposed within the inner chamber, wherein the line end termination device is operable to connect to the end of the line, and wherein the line end termination device comprises:

a first compression member;

a second compression member, wherein the first compression member and the second compression member are configured to accommodate therebetween armor wires of the line, and wherein the first compression member and the second compression member are movable with respect to each other between:

a first position in which the first compression member and the second compression member are close together such that the first compression member and the second compression member compress the armor wires therebetween to thereby connect the line end termination device to the end of the line and therefore connect the downhole tool to the end of the line; and a second position in which the first compression member and the second compression member are separated from each other such that the first compression member and the second compression member do not compress the armor wires thereby permitting the armor wires to be removed from between the first compression member and the second compression member to thereby disconnect the line end termination device from the end of the line; and a latching member comprising a plurality of shoulders each extending in a radially inward direction, wherein the latching member is movable between:

a first position in which the shoulders are latched against the first compression member thereby preventing the first compression member and the second compression member from moving away from each other; and a second position in which the shoulders are not latched against the first compression member thereby permitting the first compression member and the second compression member to move away from each other toward their second position.

12. The apparatus of claim 11 wherein the first compression member comprises a socket, and wherein the second compression member comprises a wedge.

13. The apparatus of claim 11 wherein:

the line end termination device further comprises a rotatable member disposed against the second compression member;

the latching member further comprises a base and a plurality of fingers;

each of the fingers connects a corresponding instance of the shoulders to the base;

the rotatable member comprises an external surface comprising external threads;

the base comprises an inner surface defining an axial bore;

the inner surface comprises internal threads;

the rotatable member extends though the axial bore; and the internal threads and the external threads engage such that, when the armor wires are between the first compression member and the second compression member and the latching member is in its first position, rotation of the rotatable member with respect to the latching member causes relative movement between the latching member and the rotatable member thereby forcing the first compression member and the second compression member to move toward their first position.

14. The apparatus of claim 13 wherein the rotatable member is rotatably connected to the second compression member.

15. The apparatus of claim 11 wherein:

the body assembly comprises an inner surface defining the inner chamber;

the inner chamber comprises:

a first chamber portion having a first inner diameter; and a second chamber portion having a second inner diameter;

the first inner diameter is smaller than the second inner diameter;

when the shoulders are disposed within the first chamber portion, the shoulders are disposed against the inner surface thereby preventing the shoulders from moving in a radially outward direction to maintain the latching member in its first position and therefore maintain the first compression member and the second compression member in their first position;

when the shoulders are disposed within the second chamber portion, the shoulders are not disposed against the inner surface thereby permitting the shoulders to move in the radially outward direction to permit the latching member to move toward its second position and therefore permit the first compression member and the second compression member to move toward their second position; and when the downhole tool is connected to the end of the line and conveyed within the wellbore and when a predetermined tension is applied to the line, the predetermined tension causes the line end termination device to move along the inner chamber such that the shoulders move from the first chamber portion toward the second chamber portion.

* * * * *